US005592158A

United States Patent [19]

Riffaud

[11] Patent Number: 5,592,158

[45] Date of Patent: Jan. 7, 1997

[54] INITIALIZATION BEACON FOR INITIALIZING A STATIONARY VEHICLE

[75] Inventor: Didier Riffaud, Choisy le Roi, France

[73] Assignee: GEC Alsthom Transport SA, Paris, France

[21] Appl. No.: 343,927

[22] Filed: Nov. 17, 1994

[30] Foreign Application Priority Data

Nov. 23, 1993 [FR] France ..... 93 13989

[51] Int. Cl.[6] ..... G08G 1/01

[52] U.S. Cl. ..... 340/941; 340/933; 246/122 R; 246/187 B

[58] Field of Search ..... 340/992, 933, 340/941; 246/122 R, 187 B, 34 R, 63 R, 249

[56] References Cited

U.S. PATENT DOCUMENTS

| | | | |
|---|---|---|---|
| 3,027,544 | 3/1962 | Atkinson et al. | 246/122 R |
| 3,327,111 | 6/1967 | Frech et al. | 246/122 R |
| 3,728,539 | 4/1973 | Thorne-Booth | 246/187 B |
| 3,786,411 | 1/1974 | Kurauchi et al. | 340/933 |
| 3,877,666 | 4/1975 | Itakura et al. | 246/122 R |
| 3,906,436 | 9/1975 | Kurauchi et al. | 246/122 R |
| 3,979,091 | 9/1976 | Gagnon et al. | 246/122 R |
| 4,301,899 | 11/1981 | McSparran et al. | 246/187 B |
| 4,354,649 | 10/1982 | Murr et al. | 246/187 B |
| 4,582,279 | 4/1986 | Pontier | 340/933 |
| 4,674,054 | 6/1987 | Ikeda et al. | 246/187 B |

FOREIGN PATENT DOCUMENTS 2216157 8/1974 France .

OTHER PUBLICATIONS

French Search Report FR 9313989.

*Primary Examiner*—Jeffery Hofsass
*Assistant Examiner*—Benjamin C. Lee
*Attorney, Agent, or Firm*—Sughrue, Mion, Zinn, Macpeak & Seas

[57] ABSTRACT

An initialization beacon for initializing a stationary vehicle, particularly for assisting the driving, operation, and maintenance of the stationary vehicle, comprises superposing cross-over structures Si, whereby each cross-over structure is made from a first electrical cable Ci1 and a second electrical cable Ci2. The first electrical cable Ci1, which mutually parallels with the second electrical cable over most of its length, crosses over the second electrical cable Ci2 to form a succession of magnetic nodes N. The magnetic nodes of each of the superposed cross-over structure form magnetic nodes Nij in the superposed cross-over structures. The magnetic nodes NiJ are staggered in a non-overlapping fashion according to a space period in each of the superposed cross-over structures. Pairs Pmn of the superposed cross-over structure Si can be successively powered at a clock frequency FH and a data frequency FD.

9 Claims, 6 Drawing Sheets

INITIALIZATION BEACON FOR INITIALIZING A STATIONARY VEHICLE

The present invention relates in general to automatic systems (ground systems and on-board systems) for monitoring traffic on urban transport networks, and it relates more particularly to an initialization beacon for initializing a stationary vehicle, in particular for a system for assisting driving, operation, and maintenance.

BACKGROUND OF THE INVENTION

For example, a state-of-the art system for assisting driving, operation, and maintenance is described in the June 1990 issue of the "Revue Générale des Chemins de Fer" ["General Railways Journal"].

In that journal, articles entitled "SACEM: objectifs et specifications" ["SACEM: aims and specifications"] pages 13 to 18, "Principes et fonctionnement du Systéme d'Aide à la Conduite, à l'Exploitation, et à la Maintenance (SACEM)" ["Principles and workings of the System for Assisting Driving, Operation, and Maintenance (SACEM)"] pages 23 to 28, and "L'installation du système SACEM sur la ligne A du RER" ["Installing the SACEM system on RER line A"] pages 47 to 51, supply a detailed description of the system.

The "SACEM" system for assisting driving, operation, and maintenance is a traffic monitoring system designed for high-throughput rail transport systems.

The on-board equipment is composed of a computer associated with antennas. The antennas receive the continuous-transmission electrical signals (flowing through the rails) which supply a description of a portion of line to the trains. The antennas also make it possible to read the contents of messages transmitted by beacons at various locations.

The beacons employed by the system for assisting driving, operation, and maintenance are used to supply a precise geographical position marker to the train in the track description in its possession.

Three categories of beacon are currently employed to perform that function.

The first category may be referred to as a "running-initialization" beacon. That beacon supplies the information required for the train to locate itself for the first time. Until then, the train is not initialized.

The second category of beacon may be referred to as a "relocation beacon" and it is designed to provide a new setting for the measurement of the displacement of the train periodically (about every 500 meters).

The third category of beacon supplies information to the train locating a point at which the train leaves a zone monitored by the system for assisting driving, operation, and maintenance.

Because of their structure, those three categories of beacons can be read only when the train is moving.

Transmission is not hindered by the presence of snow, ice, water, or even ore or iron filings on the beacons.

The above-described speed-monitoring system includes beacons at various locations, i.e. passive ground beacons, enabling a reference in space to be obtained.

Each initialization beacon defines a stationary-initialization zone. On entering one of such monitoring zones, an initialization beacon is read while the train is moving. It is important to note that the initialization is performed while the train is running.

To enable initialization to be performed while the train is stationary, and therefore to enable the train to be monitored as soon as its on-board equipment is switched on, it must be possible to transmit the train-location information while the train is stationary. To be entirely safe, such transmission must be performed by continuous transmission, and must enable the train to locate itself in the track description supplied to it.

OBJECTS AND SUMMARY OF THE INVENTION

An object of the invention is to provide an initialization beacon for initializing a stationary vehicle, in particular for a system for assisting driving, operation, and maintenance, which beacon makes it possible to perform initialization while the vehicle is stationary, and therefore to monitor the vehicle as soon as its on-board equipment is switched on.

Another object of the invention is to provide an initialization beacon for initializing a stationary vehicle, which beacon makes it possible to use the equipment already on board the train.

Another object of the invention is to provide an initialization beacon for initializing a stationary vehicle, where the information content of the information transmission from the beacon is independent from the adjacent stationary-initialization zones.

Another object of the invention is to provide an initialization beacon for initializing a stationary vehicle, which beacon has a safety level that is compatible with the safety aims of the system for assisting driving, operation, and maintenance.

Said safety aims are that the probability of the initialization apparatus supplying unsafe information is less than some given minimum breakdown threshold of about $10^{-9}$ to $10^{-12}$ breakdowns per hour, i.e. one breakdown every one million years.

The stationary-initialization apparatus for a system for assisting driving, operation, and maintenance includes on-board equipment, and ground installations, so as to enable messages to be transmitted.

According to the invention, the initialization beacon for initializing a stationary vehicle is wherein:

- the magnetic nodes Nij of any given cross-over structure Si are distributed, in compliance with a space period, along said cross-over structure; and
- the cross-over structures Si are powered successively in pairs Mn, and successively at a clock frequency FH and at a data frequency FD.

The invention also provides an initialization beacon satisfying any one of the following characteristics:

- the pairs Pmn of cross-over structures are composed of a first cross-over structure Sm and of a second crossover structure Sn offset relative to the first cross-over structure Sm by one half of the space period between two successive magnetic nodes Nij of the same cross-over structure Si;
- a binary 1 is transmitted by applying the following to said cross-over structures Sm, Sn composing a given pair Pmn of cross-over structures:
  - a clock signal at frequency FH successively to the first cross-over structure Sm, to the second cross-over structure Sn, and to the first cross-over structure Sm; then a data signal at frequency FD successively to the first cross-over structure Sm, to the second cross-over structure Sn, and to the first cross-over structure Sm; and a clock signal at frequency FH successively to the first cross-over structure Sm, to the second cross-over structure Sn, and to the first cross-over structure Sm;

a binary 0 is transmitted by applying the following to said cross-over structures Sm, Sn composing a given pair Pmn of cross-over structures:

a clock signal at frequency FH successively to the first cross-over structure Sm, to the second cross-over structure Sn, and to the first cross-over structure Sm; then a data signal at frequency FD to the first cross-over structure Sm; and a clock signal at frequency FH successively to the first cross-over structure Sm, to the second cross-over structure Sn, and to the first cross-over structure Sm.

According to another characteristic of the invention, virtual cross-over structures S'l are generated by powering a first real cross-over structure Sl−1 and a second cross-over structure Sl+1.

The invention also provides an initialization beacon satisfying any one of the following characteristics:

the real cross-over structures Si are powered successively in double pairs and successively at a clock frequency FH and at a data frequency FD;

a binary 1 is transmitted by simulating a first clock signal followed by a data signal followed by a second clock signal at the virtual nodes of a virtual pair of virtual cross-over structures;

a binary 0 is transmitted by simulating a first clock signal followed by a second clock signal at the virtual nodes of a virtual pair of virtual cross-over structures, without a data signal appearing between said clock signals; and the loop passes the clock signal at the clock frequency FH when one of the two cross-over structures Sm, Sn of the pair Pmn of cross-over structures passes the data signal, and said loop passes the data signal at the data frequency FD when one of the two cross-over structures Sm, Sn of the pair Pmn of cross-over structures passes the clock signal.

BRIEF DESCRIPTION OF THE DRAWINGS

Other objects, characteristics, and advantages of the invention will appear on reading the following description of a preferred embodiment of the stationary-initialization apparatus for a system for assisting driving, operation, and maintenance, given with reference to the accompanying drawings, in which.

MORE DETAILED DESCRIPTION

Figure 1:
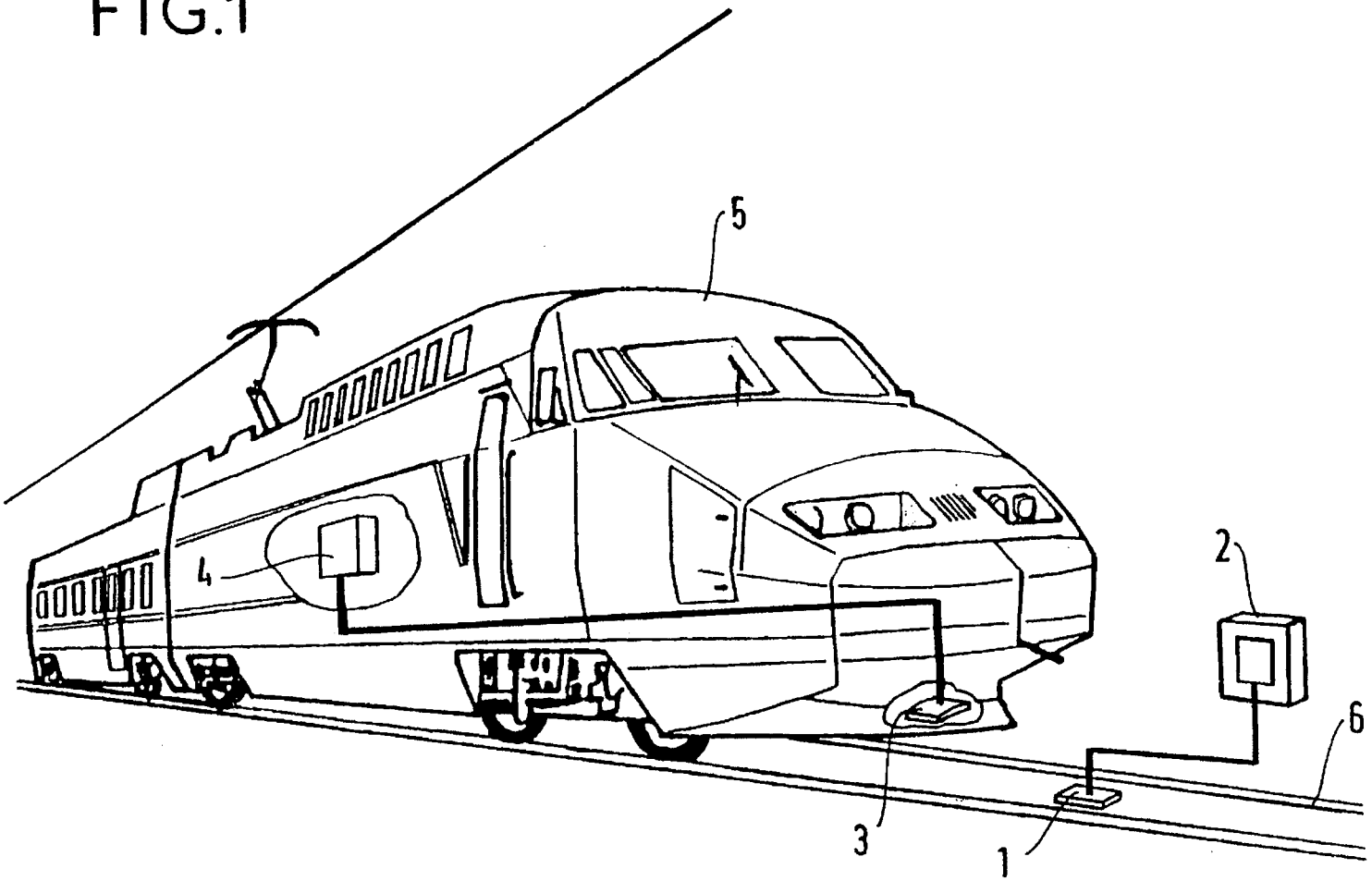
FIG.1 PRIOR ART
FIG. 1 is a general view of a state-of-the-art system for assisting driving, operation, and maintenance, comprising equipment on board a rail vehicle, and an installation on the ground.

FIG. 1 is a general view of a state-of-the-art system for assisting driving, operation, and maintenance.

The system comprises ground installations 1, 2 and on-board equipment 3,4 on a rail vehicle 5.

The ground installations are composed of a beacon 1 and of their control electronic circuitry 2.

The beacon 1 is fixed on the ties or "sleepers" on the axis of the rail track 6.

The on-board equipment is composed mainly of an antenna 3 and of an evaluation unit 4.

The evaluation unit 4, which may be a computer, is powered by its own converter, and is connected to the antenna 3.

The antenna is situated under the rail vehicle 5, preferably at the front of the vehicle.

Figure 2A:
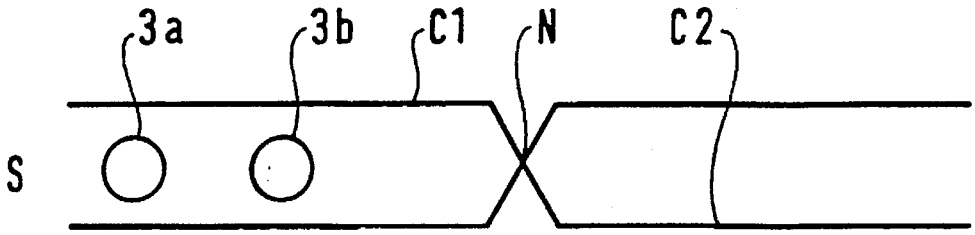
PRIOR ART FIG. 2A
FIGS. 2A to 2C show the disposition of a cross-over structure of the ground installation relative to the on-board equipment of the system shown in FIG. 1.
Figure 2B:
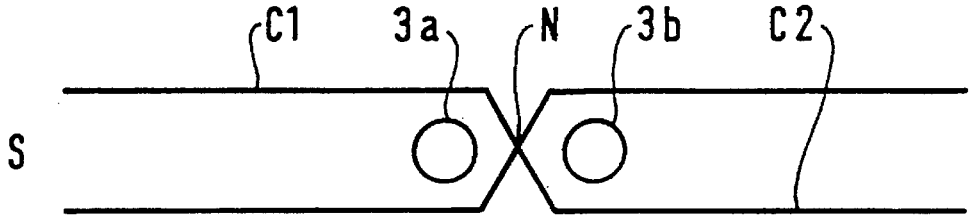
PRIOR ART FIG. 2B
Figure 2C:
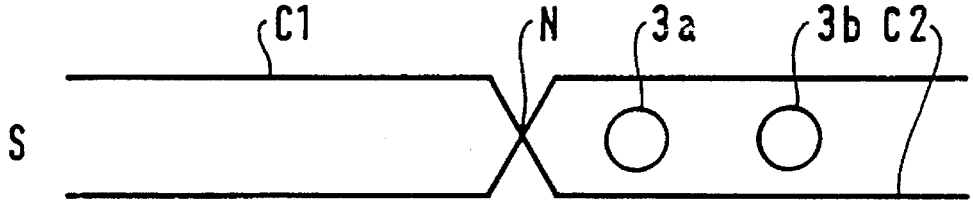
PRIOR ART FIG. 2C

FIGS. 2A to 2C show the disposition of a cross-over structure of the beacon constituting the ground installation relative to the sensors of the antenna of the on-board equipment of FIG. 1.

The cross-over structure S is constituted by a first electrical cable C1 and by a second electrical cable C2.

The first electrical cable C1 is parallel to the second electrical cable C2 over most of its length.

However, the first electrical cable C1 of the cross-over structure S crosses over the second electrical cable C2 so that the cross-over structure S is composed of a series of cross-overs between cables forming magnetic nodes N.

The resulting magnetic nodes N are distributed along the central longitudinal axis of the cross-over structure S.

In this way, the cross-over structure S has the appearance of a strip radially delimited by a first electrical cable C1 and by a second electrical cable C2, along which strip magnetic nodes N are distributed.

The electrical cables pass an electrical current whose frequency is representative of the information to be transmitted.

The antenna 3 is constituted by a first sensor 3a and by a second sensor 3*b* designed to be displaced along the axis of the track, and more particularly vertically above the cross-over structure S.

The sensors are spaced apart from one another longitudinally so as to be disposed on the axis of the rail track.

For example, the sensors are coils spaced apart at a distance of about 4 cm.

By positioning the sensors 3*a*, 3*b* of the antenna vertically above a cross-over structure S, a first magnetic field and a second magnetic field are generated in each of the sensors of the antenna. The magnetic fields are used by means of known electronic circuits (not shown) to supply a binary logic signal transmitted to the evaluation unit.

Figure 2D:
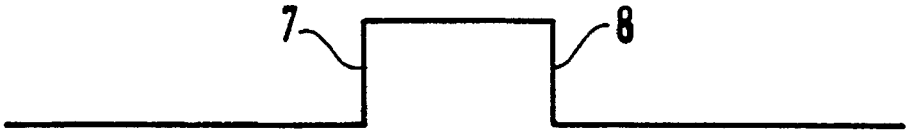
PRIOR ART FIG. 2D
FIG. 2D shows, in association with FIGS. 2A to 2C, the binary logic signal delivered by the antenna as a function of the position of the antenna relative to a cross-over structure.

FIG. 2D shows, in association with FIGS. 2A to 2C, the binary logic signal delivered by the antenna as a function of its position relative to the cross-over structure.

In the absence of a magnetic node N (FIG. 2A and 2C) between the two sensors 3*a*, 3*b* of the antenna, the first and second magnetic fields generated in each of the sensors are in phase opposition with each other, and the binary logic signal has the value 1.

The rising edge 7 of the binary logic signal appears when the first sensor passes beyond the magnetic node.

The falling edge 8 of the binary logic signal appears when the second sensor passes beyond the magnetic node.

In this way, passing over a magnetic node of a cross-over structure causes two magnetic fields to appear that are successively in-phase and anti-phase.

For example, the following rule may be set:

when the sensors of the antenna detect a magnetic node, i.e. the presence of a cross-over between two cables of the same cross-over structure, a binary logic signal of value 1 is transmitted; and when no magnetic nodes are detected, i.e. the sensors of the antenna are situated between two successive magnetic nodes, a binary logic signal of value 0 is transmitted.

Naturally, the opposite rule may be applied.

Such binary logic signal transmission takes place from the cross-over structures of a beacon to the antenna, and then to the evaluation unit.

Figure 3:
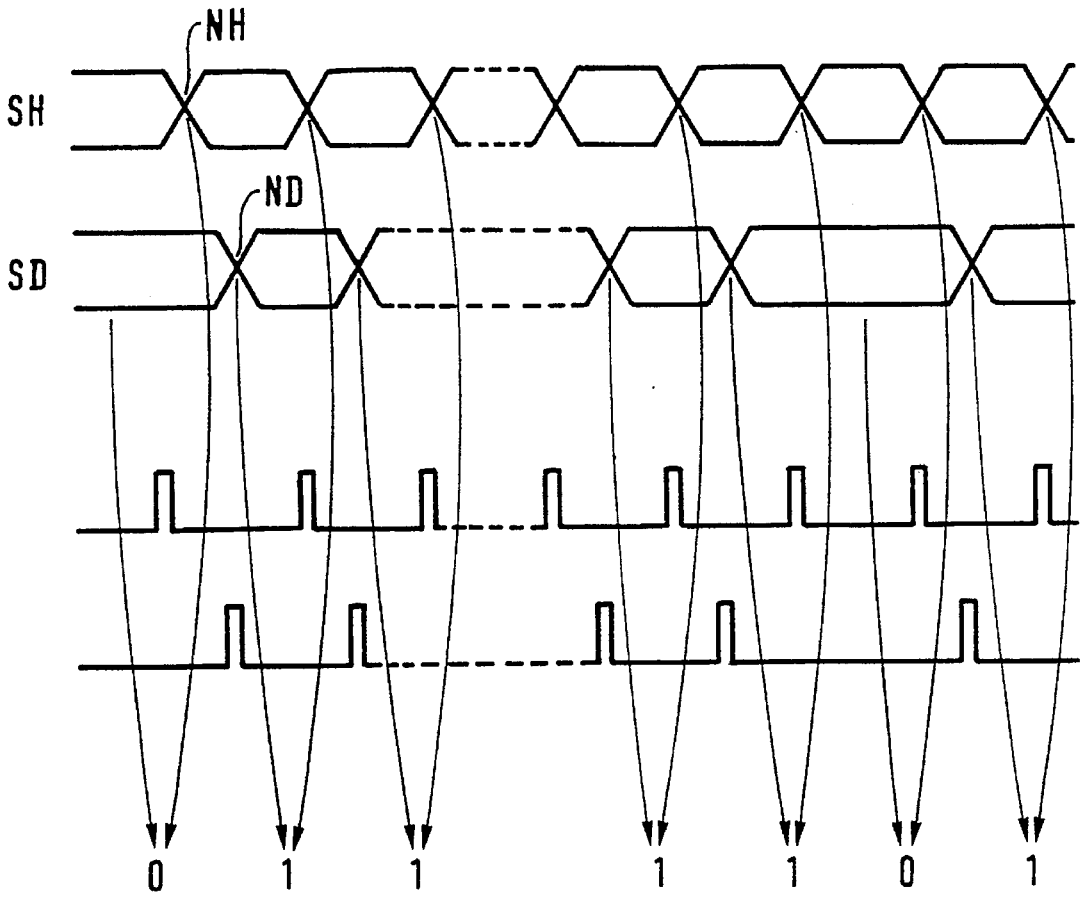
PRIOR ART FIG. 3
FIG. 3 shows a timing diagram of the clock signals and of the data output by two state-of-the-art cross-over structures, and the states of the bits of the message signal deduced from the signals.

FIG. 3 shows a timing diagram of a clock signal and of a data signal output by two state-of-the-art cross-over structures.

FIG. 3 also shows the states of the bits of the message signal deduced from those signals.

The cross-over structure SH used for transmitting the clock signal and the cross-over structure SD used for transmitting the data signals are shown diagrammatically in FIG. 3.

By way of example, a first cross-over structure SH may be dedicated to transmitting a clock signal. The frequency of the electrical current passing through the structure may, for example, be about 90 kHz non-modulated.

For example, the space distribution period of the magnetic nodes NH along the cross-over structure for transmitting the clock signals is about 16 cm.

Another cross-over structure SD is dedicated to transmitting data signals. The frequencies of the electrical currents passing through these structures may, for example, be about 110 kHz and 123.7 kHz, non-modulated.

The distribution in space of the magnetic nodes ND along the cross-over structure for transmitting the data signals is a function of the data to be transmitted.

The magnetic nodes NH of the cross-over structures for transmitting the clock signals are distributed periodically along the cross-over structure SH in question.

The magnetic nodes ND of the cross-over structures for transmitting the data signals are not necessarily distributed periodically along the cross-over structure in question, but rather they appear as a function of the states of the bits constituting the message to be transmitted.

To enable error-free detection to be obtained between magnetic nodes NH for clock signals and magnetic nodes ND for data signals, the magnetic nodes are not superposed relative to one another.

As a result, the magnetic nodes ND of the cross-over structures for transmitting the data signals are disposed between the magnetic nodes NH of the cross-over structures for transmitting the clock signal.

Also as a result, as represented diagrammatically by the arrows shown in FIG. 3, the message includes a binary 1 when a magnetic node ND for data signals appears between two successive magnetic nodes NH for clock signals.

Conversely, the message includes a binary 0 when a magnetic node ND for data signals does not appear between two successive magnetic nodes NH for clock signals.

A major drawback of the above-described state-of-the-art cross-over structure for transmitting the data signals is that it applies to one message only. Changing the message involves changing the cross-over structure.

Figure 4:
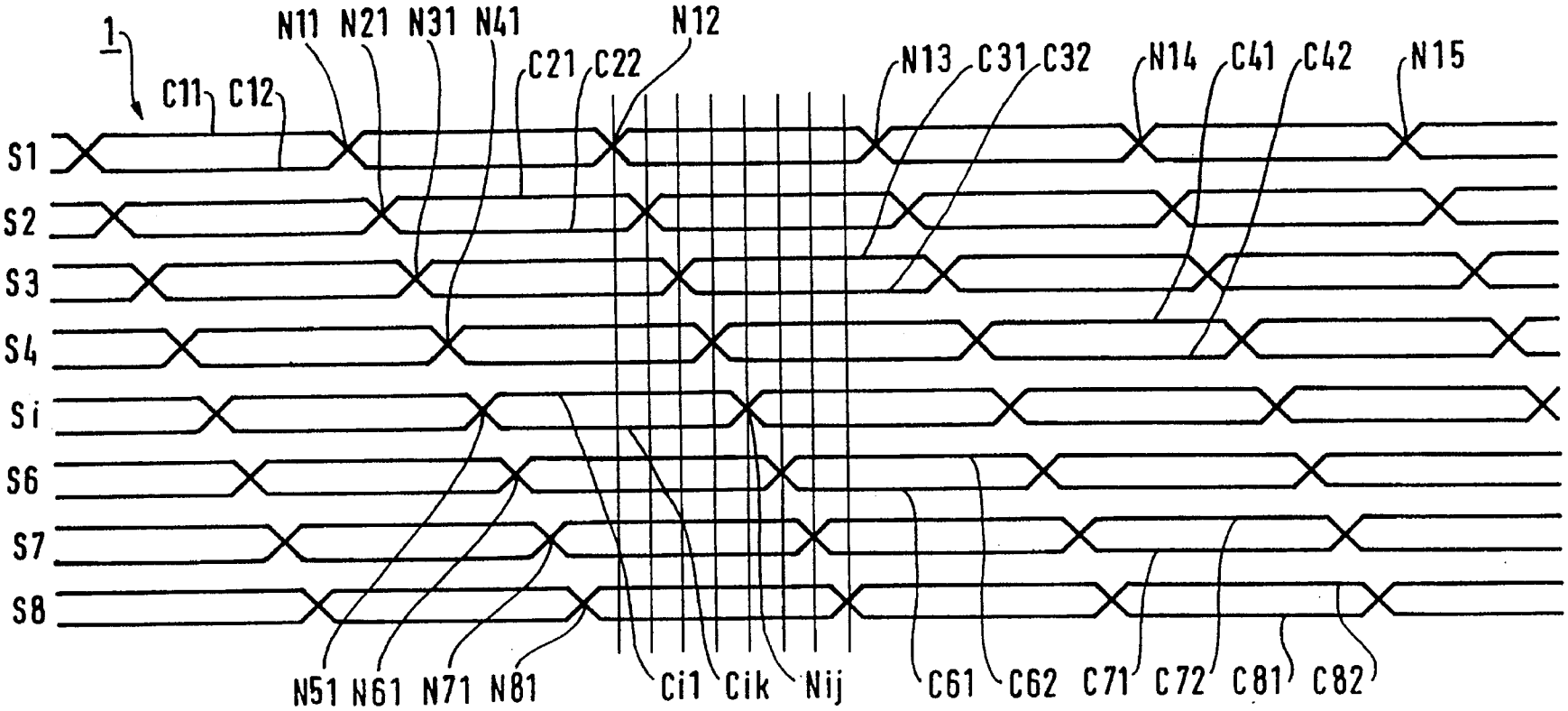
FIG. 4 shows a beacon of the ground installation of stationary-initialization apparatus in a first preferred embodiment of the invention.

FIG. 4 shows a beacon of the ground installation of stationary-initialization apparatus in a first preferred embodiment of the invention.

The beacon 1 of the ground installation is composed of eight cross-over structures Si (where i lies in the range 1 to 8). The cross-over structures Si are superposed on one another so as to constitute a multi-layer structure that is plane in overall geometrical shape. In other words, the plane cross-over structures Si are disposed one on top of another in horizontal planes that are mutually parallel. Therefore, FIG. 4 merely represents the beacon diagrammatically, the cross-over structures Si that are shown therein not being in their real positions.

Each of the cross-over structures Si is constituted by a first electrical cable Cik (where i lies in the range 1 to 8, and k is equal to 1) and by a second electrical cable Cik (where i lies in the range 1 to 8, and k is equal to 2).

The first and second cables are parallel to each other over most of their lengths.

However, each of the first electrical cables Ci1 of each of the cross-over structures Si crosses over the electrical cable Ci2 that is associated with it so that each of the cross-over structures is composed of a series of cross-overs between electrical cables so as to form magnetic nodes Nij (where lies in the range 1 to 8, and j lies in the range 1 to the total number of magnetic nodes contained in a cross-over structure).

The resulting magnetic nodes Nij are distributed in compliance with a space period along the central longitudinal axis of the multi-layer structure.

In this way, each of the cross-over structures Si has the appearance of a strip radially delimited by the first electrical cables Ci1 and by the second electrical cables Ci2, along which strip nodes Nij are distributed.

As indicated above, to enable error-free detection to be obtained between magnetic nodes NH for clock signals, and magnetic nodes ND for data signals, the magnetic nodes are not superposed on one another.

This limits the number of cross-over structures that can be used.

The electrical cables pass an electrical current whose frequency is representative of the information to be transmitted.

A result of the geometrical structure of the beacons of the stationary-initialization apparatus of the invention is that, regardless of the position of the stationary rail vehicle on the rail track, the sensors of the antenna are positioned on either side of a magnetic node.

To this end, and in a possible embodiment, the distance between sensors is about 40 mm. The magnetic nodes of a cross-over structure are offset relative to the following cross-over structure by about 20 mm.

By way of example, a minimum space period of 160 mm between magnetic nodes of the same cross-over structure enables eight offset cross-over structures to be used.

To reduce the value of the space period of the magnetic nodes, e.g. to 120 mm or to 80 mm, it is necessary to reduce the height of the two sensors of the antenna.

For a space period of about 160 mm, the height of the two sensors of the antenna is about 200 mm. For a space period of about 80 mm or of about 120 mm, the height of the two sensors of the antenna is about 100 mm and about 150 mm, respectively.

The antenna disposed on the rail vehicle is stationary vertically above the beacon when the beacon is to transmit the message to the evaluation unit via the antenna.

In accordance with an essential characteristic of the invention, the displacement of the rail vehicle is simulated at the beacon. The message must then be transmitted via one of the cross-over structures.

For that purpose, the cross-over structures are powered successively in pairs Pmn (where m is equal to 1, 2, 3, or 4, and n is respectively equal to 5, 6, 7, or 8), and successively at the clock frequency and at the data frequency.

A pair of cross-over structures includes a first cross-over structure Sm taken as a reference and co-operating with a second cross-over structure sn.

The second cross-over structure Sn is the only one which is offset relative to the first cross-over structure Sm, for example, by one half of a space period, i.e. 80 mm.

It transpires that the number of pairs is given by the value of the space period between the magnetic nodes of the same cross-over structure and by the distance between the sensors constituting the antenna.

Tables 1 and 2 respectively show a sequence enabling a binary 1 and a binary 0 to be transmitted by means of one of the pairs of cross-over structures.

It is recalled that, in the state-of-the-art cross-over structures described with reference to FIG. 3, a binary 1 is detected by the antenna when a magnetic node for data signals appears between two successive magnetic nodes for clock signals.

With the initialization apparatus of the invention, a binary 1 is detected by the antenna when a pair of cross-over structures simulates a first clock signal followed by a data signal, followed by a second clock signal at its magnetic nodes.

It is important to note that the signals appear at each of the nodes of the pair of cross-over structures in question, but that only those signals which are transmitted by the only magnetic node disposed vertically below the antenna are detected by the antenna.

Similarly, a binary 0 is detected by the antenna when a pair of cross-over structures simulates a first clock signal and a second clock signal at the magnetic nodes without a data signal appearing between the two successive clock signals.

The sequences described for one of the pairs of cross-over structures are applied successively to all of the pairs of cross-over structures.

In the following tables:

Si (where lies in the range 1 to 8) designates the cross-over structures;

D indicates that a data signal flows at the frequency allocated to the data signals over the cross-over structure in question in the chosen pair of cross-over structures; and H indicates that a clock signal flows at the frequency allocated to the clock signals over the cross-over structure in question in the chosen pair of cross-over structures.

The letter B also appears in these tables. The letter B designates a cross-over-free structure forming a loop disposed longitudinally at the periphery of the cross-over structures. This optional loop is constituted by an electrical conductor, and its function is to remove any interference signals that may appear in the beacon.

The loop passes the clock signal at the above-defined clock frequency FH when one of the two cross-over structures of the pair of cross-over structures passes the data signal, and the loop passes the data signal at the above-defined data frequency FD when one of the two cross-over structures of the pair of cross-over structures passes the clock signal.

TABLE 1

| S1 | S2 | S3 | S4 | S5 | S6 | S7 | S8 | B |
|---|---|---|---|---|---|---|---|---|
| H | | | | | | | | D |
| | | | | H | | | | D |
| H | | | | | | | | D |
| D | | | | | | | | H |
| | | | | D | | | | H |
| D | | | | | | | | H |
| H | | | | | | | | D |
| | | | | H | | | | D |
| H | | | | | | | | D |

TABLE 2

| S1 | S2 | S3 | S4 | S5 | S6 | S7 | S8 | B |
|---|---|---|---|---|---|---|---|---|
| H | | | | | | | | D |
| | | | | H | | | | D |
| H | | | | | | | | D |
| D | | | | | | | | H |
| D | | | | | | | | H |
| D | | | | | | | | H |
| H | | | | | | | | D |
| | | | | H | | | | D |
| H | | | | | | | | D |

Figure 5:
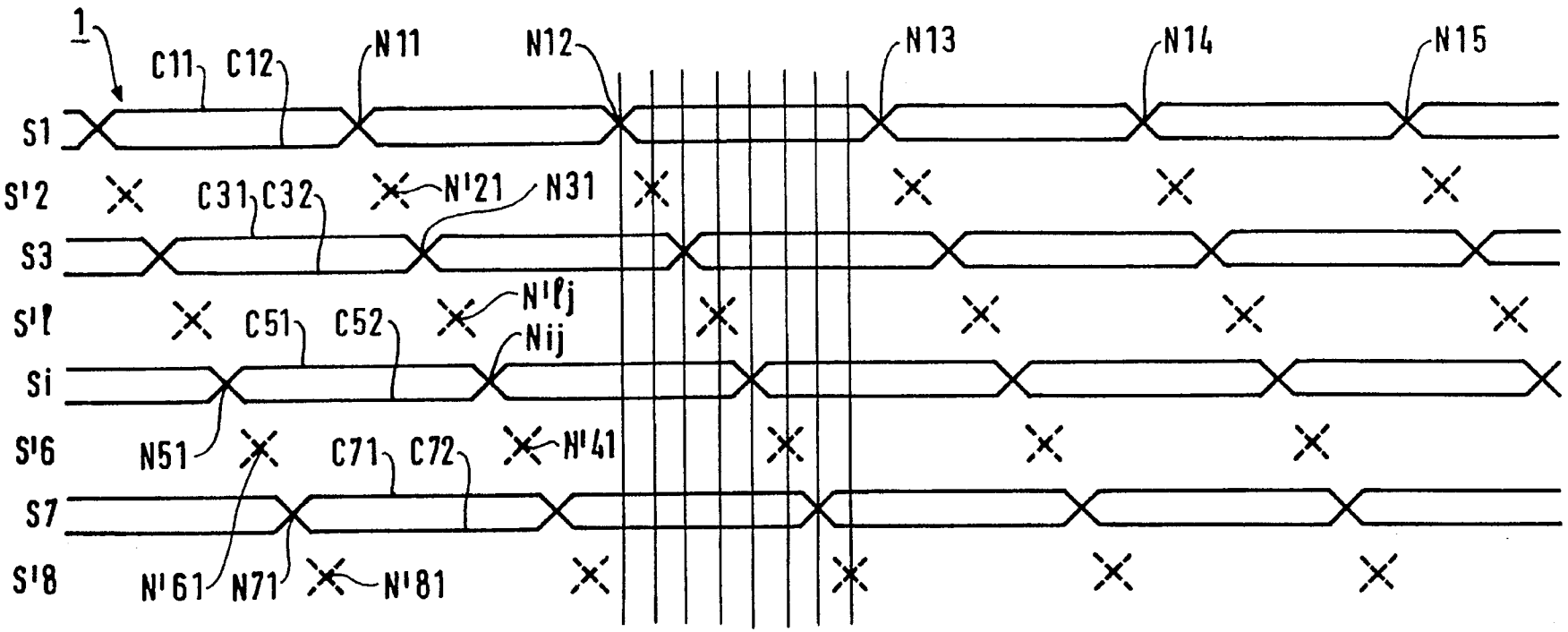
FIG. 5 shows a beacon of the ground installation of stationary-initialization apparatus in a second preferred embodiment of the invention.

FIG. 5 shows a beacon of the ground installation of stationary-initialization apparatus in a second preferred embodiment of the invention.

The cross-over structures Si are superposed on one another so as to constitute a multi-layer structure that is plane in overall geometrical shape. In other words, the plane cross-over structures Si are disposed one on top of another in horizontal planes that are mutually parallel. Therefore, FIG. 5 also merely represents the beacon diagrammatically, the cross-over structures Si that are shown therein not being in their real positions.

An object of the second preferred embodiment is to halve the number of cross-over structures.

An advantage of the stationary-initialization apparatus of the second preferred embodiment of the invention is that the cost and the length of the electrical cables are reduced, and the control electronic circuitry is simplified.

As indicated above, the magnetic nodes Nij of the same cross-over structure Si of a beacon 1 of the ground installation are distributed in compliance with a space period, e.g. equal to 160 mm.

Because only four real cross-over structures Si are used (where i takes the values 1, 3, 5, or 7), said structures are offset from one another by one fourth of the space period of the magnetic nodes of the same cross-over structure, namely 40 mm.

In accordance with the essential characteristic of the second preferred embodiment of the invention, it is possible to generate an additional cross-over structure, and therefore a series of additional magnetic nodes, by means of two real cross-over structures.

By suitably combining the four real cross-over structures Si in pairs, it is in fact possible to create four virtual cross-over structures S'l (where l takes the value 2, 4, 6, or 8).

The additional cross-over structures are referred to as virtual cross-over structures because the additional magnetic nodes of these virtual cross-over structures have no physical existence. These additional magnetic nodes are therefore also virtual but they can be detected by the antenna under the same conditions as the real magnetic nodes.

A virtual cross-over structure S'l is created by powering a first real cross-over structure Sl–1 taken as a reference co-operating with a second real cross-over structure Sl+1.

The second real cross-over structure Sl+i is the only one that is offset from the first cross-over structure by a value equal to one fourth of the space period of the magnetic nodes Sl+1 of the same cross-over structure Nij.

The beacon in the second preferred embodiment operates entirely identically to the beacon in the above-described first preferred embodiment.

The noteworthy difference is that the pairs of cross-over structures defined with reference to FIG. 3 or 4 are constituted either by two real cross-over structures or by two virtual cross-over structures.

Each of the two virtual cross-over structures are obtained by means of two real cross-over structures.

As a result, four real cross-over structures need to be used to obtain two virtual cross-over structures.

The real cross-over structures are powered successively in pairs Prs (where r is equal to 1 or 3, and s is equal to 5 or 7, respectively), and in double pairs P13, P35, and respectively P57, P71, and successively at the clock frequency and at the data frequency.

The sequence enabling a binary 1 and a binary 0 to be transmitted by means of one of the pairs of real cross-over structures is similar to that indicated in tables 1 and 2 above.

Tables 3 and 4 below respectively show a sequence enabling a binary 1 and a binary 0 to be transmitted by means of two double pairs P13 and P57 of real cross-over structures S1, S3, and S5, S7.

In these tables, Si (where i takes the values 1, 3, 5, or 7) designates the real cross-over structures, and the letter B designates the above-described single loop structure.

As above:

D indicates that a data signal flows at the frequency allocated to the data signals over the real cross-over structures in question in the chosen pair of cross-over structures; and H indicates that a clock signal flows at the frequency allocated to the clock signals over the real cross-over structures in question in the chosen pair of cross-over structures.

TABLE 3

| S1 | S3 | S5 | S7 | B |
|---|---|---|---|---|
| H | H | | | D |
| | | H | H | D |
| H | H | | | D |
| D | D | | | H |
| | | D | D | H |
| D | D | | | H |
| H | H | | | D |
| | | H | H | D |
| H | H | | | D |

TABLE 4

| S1 | S3 | S5 | S7 | B |
|---|---|---|---|---|
| H | H | | | D |
| | | H | H | D |
| H | H | | | D |
| D | D | | | H |
| D | D | | | H |
| D | D | | | H |
| H | H | | | D |
| | | H | H | D |
| H | H | | | D |

With reference to Table 4, the two real cross-over structures S1 and S3 enable one virtual cross-over structure S'2 to be created. In the same way, the two real cross-over structures S5 and S7 enable one virtual cross-over structure S'6 to be created.

After the two virtual cross-over structures have been created, they co-operate together to form a pair P'26 of virtual cross-over structures that can be operated as above.

In this case, a binary 1 is detected by the antenna when a first clock signal followed by a data signal followed by a second clock signal are simulated at the virtual magnetic nodes of the virtual pair of virtual cross-over structures.

It is important to note that these signals appear at each of the virtual nodes of the virtual pair of virtual cross-over structures in question, but that only those signals which are transmitted by the only virtual magnetic node disposed vertically below the antenna are detected by the antenna.

Similarly, a binary 0 is detected by the antenna when the virtual pair of virtual cross-over structures simulates a first clock signal and a second clock signal at the virtual magnetic nodes without a data signal appearing between the two successive clock signals.

Figure 6:
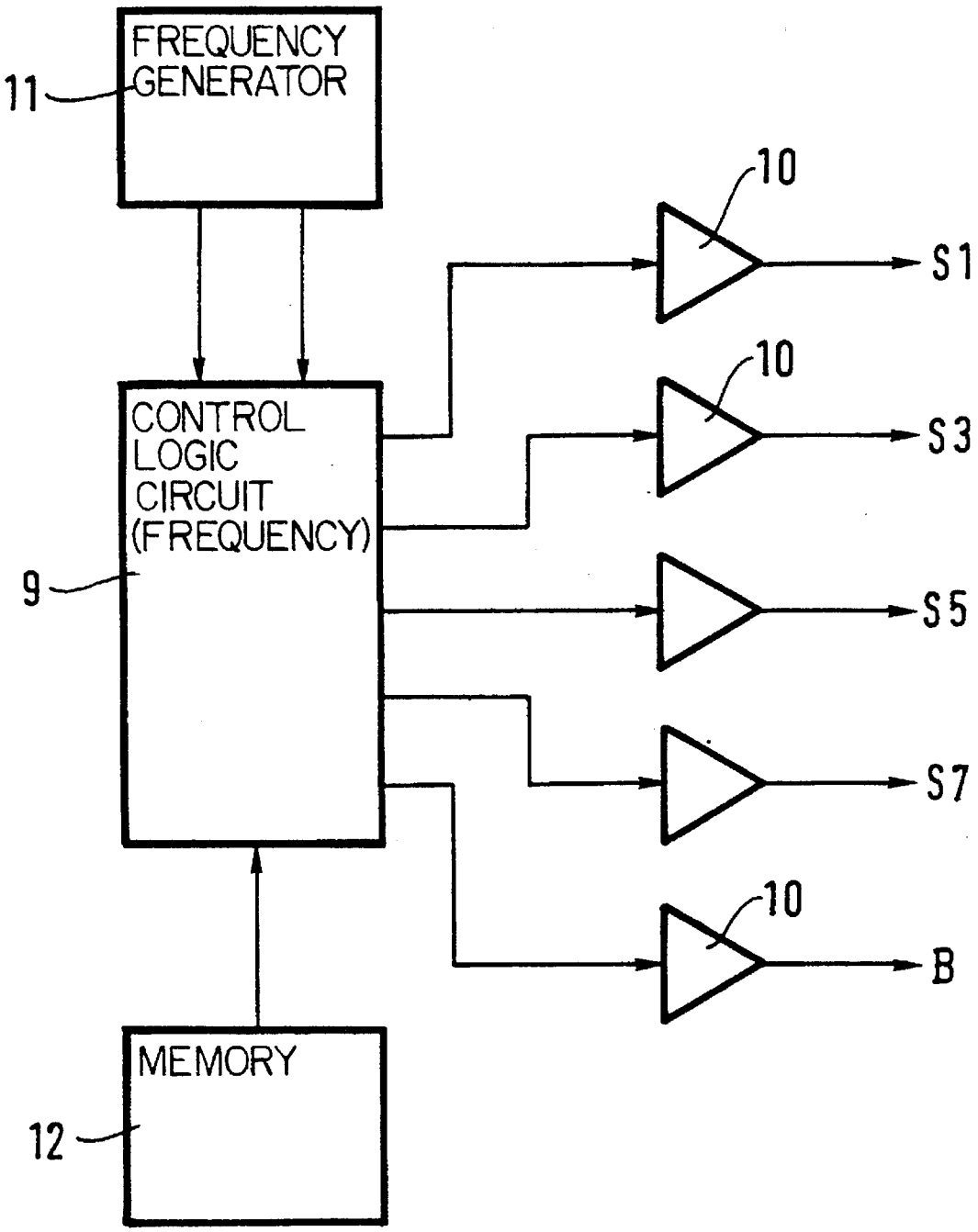
FIG. 6 shows a block diagram of the electronic circuitry for controlling a beacon of the ground installation of stationary-initialization apparatus of the invention.

FIG. 6 is a block diagram showing the control electronic circuitry of a beacon of the ground installation of the invention.

The block diagram is more particularly adapted to controlling the beacon of the ground installation of the stationary-initialization apparatus in the second preferred embodiment of the invention.

The beacon of the ground installation of the second preferred embodiment of the invention includes four real cross-over structures Si (where i takes the values 1, 3, 5, or 7) and, optionally, a single loop structure B.

The electrical currents flowing through the various cross-over structures are frequency controlled by means of a control logic circuit 9, e.g. a sequence, via power amplifiers 10. The frequency-control logic circuit 9 for the cross-over structures Si and for the single loop structure B is connected to a frequency generator 11 and to a circuit 12, e.g. a memory, transmitting the succession of logic bits composing the message to be transmitted.

The frequency generator 11 generates two frequencies, namely a frequency FH dedicated to the clock signal, and a frequency FD dedicated to the data signals.

The circuit 12 generates the message that is to reach the evaluation unit by means of the cross-over structures Si via the antenna.

The above-described preferred embodiments are limited to a beacon of the ground installation constituted by eight cross-over structures. Naturally, the above-defined principles can easily be generalized to a beacon of the ground installation constituted by a greater number of cross-over structures than eight.

I claim:

1. An initialization beacon for initializing a stationary vehicle, the beacon comprising:

a plurality of cross-over structures Si, each cross-over structure being constituted by a first electrical cable Ci1 and a second electrical cable Ci2, which cables are mutually parallel over most of their length, the first electrical cable Ci1 crossing over the second electrical cable Ci2 so as to form a succession of magnetic nodes Nij, wherein the magnetic nodes Nij of any given cross-over structure are distributed, in compliance with a space period, along said given cross-over structure; and means for successively powering pairs Pmn of said cross-over structures Si at a clock frequency FH and at a data frequency FD.

2. The initialization beacon according to claim 1, wherein said pairs Pmn of cross-over structures are composed of a first cross-over structure Sm and of a second cross-over structure Sn offset relative to the first cross-over structure Sm by one half of the space period between two successive magnetic nodes Nij of the same cross-over structure Si.

3. The initialization beacon according to claim 1, wherein a binary 0 is transmitted by applying the following to said cross-over structures Sm, Sn composing a given pair Pmn of cross-over structures:

a clock signal at frequency FH successively to the first cross-over structure Sm, to the second cross-over structure Sn, and to the first cross-over structure Sm;

a data signal at frequency FD to the first cross-over structure Sm; and a clock signal at frequency FH successively to the first cross-over structure Sm, to the second cross-over structure Sn, and to the first cross-over structure Sm.

4. The initialization beacon according to claim 1, wherein a binary 1 is transmitted by applying the following to said cross-over structures Sm, Sn composing a given pair Pmn of cross-over structures:

a clock signal at frequency FH successively to the first cross-over structure Sm, to the second cross-over structure Sn, and to the first cross-over structure Sm;

a data signal at frequency FD successively to the first cross-over structure Sm, to the second cross-over structure Sn, and to the first cross-over structure Sm; and a clock signal at frequency FH successively to the first cross-over structure Sm, to the second cross-over structure Sn, and to the first cross-over structure Sm.

5. The initialization beacon according to claim 4, wherein said loop passes the clock signal at the clock frequency FH when one of the two cross-over structures Sm, Sn of the pair Pmn of cross-over structures passes the data signal, and said loop passes the data signal at the data frequency FD when one of the two cross-over structures Sm, Sn of the pair Pmn of cross-over structures passes the clock signal.

6. The initialization beacon according to claim 1, wherein virtual cross-over structures S'l are generated by powering a first real cross-over structure Sl–1 and a second cross-over structure Si+i.

7. The initialization beacon according to claim 6, wherein said real cross-over structures Si are powered successively in double pairs and successively at a clock frequency FH and at a data frequency FD.

8. The initialization beacon according to claim 7, wherein a binary 1 is transmitted by simulating a first clock signal followed by a data signal followed by a second clock signal at the virtual nodes of a virtual pair of virtual cross-over structures.

9. The initialization beacon according to claim 7, wherein a binary 0 is transmitted by simulating a first clock signal followed by a second clock signal at the virtual nodes of a virtual pair of virtual cross-over structures, without a data signal appearing between said clock signals.

* * * * *